US012024992B2

(12) United States Patent
Tasoujian et al.

(10) Patent No.: US 12,024,992 B2
(45) Date of Patent: Jul. 2, 2024

(54) MODEL-BASED CURVATURE CRUISE CONTROL DESIGN

(71) Applicant: Halliburton Energy Services, Inc., Houston, TX (US)

(72) Inventors: Shahin Tasoujian, Houston, TX (US); Khunsa Hisham, Houston, TX (US); Yuanyan Chen, Humble, TX (US); Ketan C. Bhaidasna, Houston, TX (US); Robert P. Darbe, Tomball, TX (US); Vy Pho, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 354 days.

(21) Appl. No.: 17/686,590

(22) Filed: Mar. 4, 2022

(65) Prior Publication Data

US 2023/0279766 A1 Sep. 7, 2023

(51) Int. Cl.

| | |
|---|---|
| ***E21B 44/00*** | (2006.01) |
| ***E21B 7/04*** | (2006.01) |
| ***E21B 45/00*** | (2006.01) |
| ***E21B 47/022*** | (2012.01) |

(52) U.S. Cl.

CPC ..... *E21B 44/00* (2013.01); *E21B 7/04* (2013.01); *E21B 45/00* (2013.01); *E21B 47/022* (2013.01); *E21B 2200/20* (2020.05)

(58) Field of Classification Search

CPC ..... E21B 2200/20; E21B 44/00; E21B 45/00; E21B 47/022; E21B 7/04

USPC ..... 700/275

See application file for complete search history.

(56) References Cited

U.S. PATENT DOCUMENTS

| | | | | |
|---|---|---|---|---|
| 9,970,285 | B2 | 5/2018 | Sugiura | |
| 10,024,151 | B2 | 7/2018 | Dykstra et al. | |
| 2013/0138254 | A1 | 5/2013 | Seals et al. | |
| 2014/0196950 | A1 | 7/2014 | Bayliss | |
| 2016/0160628 | A1 | 6/2016 | Sugiura et al. | |
| 2016/0230465 | A1* | 8/2016 | Holtz | E21B 7/068 |
| 2016/0265334 | A1* | 9/2016 | Dykstra | G01V 11/002 |
| 2018/0363444 | A1* | 12/2018 | Hornblower | E21B 45/00 |
| 2020/0095860 | A1* | 3/2020 | Zalluhoglu | E21B 47/022 |
| 2021/0164293 | A1 | 6/2021 | Zhao et al. | |
| 2021/0230993 | A1* | 7/2021 | Zalluhoglu | G01V 1/50 |
| 2021/0238926 | A1 | 8/2021 | Zalluhoglu et al. | |
| 2021/0363828 | A1 | 11/2021 | Zalluhoglu et al. | |
| 2022/0170359 | A1* | 6/2022 | Boualleg | G06N 20/20 |
| 2023/0023709 | A1* | 1/2023 | Jamieson | E21B 44/00 |

OTHER PUBLICATIONS

"PCT Application No. PCT/US2022/019207, International Search Report and Written Opinion", Nov. 28, 2022, 9 pages.

* cited by examiner

*Primary Examiner* — Chun Cao

(74) *Attorney, Agent, or Firm* — DeLizio, Peacock, Lewin & Guerra, LLP

(57) ABSTRACT

A curvature cruise controller has been designed to maintain a desired curvature when drilling a curve section of a wellbore. The curvature cruise controller utilizes a model-based controller (such as an LQR controller) to generate steering inputs based on the desired curvature and attitude setpoints and real time measurements. The model-based controller is configured with a wellbore propagation model that characterizes the tool's response dynamics. The curvature cruise controller utilizes real time drilling operation parameters measurements to tune the model-based controller.

20 Claims, 5 Drawing Sheets

MODEL-BASED CURVATURE CRUISE CONTROL DESIGN

TECHNICAL FIELD

The disclosure relates to earth drilling (e.g., CPC class E21B) and automatic control systems for drilling (e.g., subclass 44/00)

BACKGROUND

Control automation is utilized throughout the oil and gas industry in applications such as directional drilling to reduce error and optimize processes. The process of drilling a wellbore in a geological formation includes directional drilling sections to guide the wellbore towards a predetermined target. Directional drilling comprises controlling the attitude (inclination and azimuth) and/or the position (True Vertical Depth, North/South, East/West) of the wellbore using drilling operation parameters and downhole tools to guide the wellbore along a planned well path (i.e., well plan) towards a predetermined target. Directional drilling is controlled to maintain the wellbore trajectory within range of the well plan to avoid additional drilling time and incorrect wellbore placement in the reservoir. As the system dynamics and geological formations vary along the wellbore, steering inputs and/or drilling operation parameters need to change to adapt to the new conditions. Automation assists directional drilling to keep the wellbore on the planned well path while minimizing error and non-productive time.

BRIEF DESCRIPTION OF THE DRAWINGS

The disclosure may be better understood by referencing the accompanying drawings.

DETAILED DESCRIPTION

The description that follows includes example systems, methods, techniques, and program flows that embody embodiments of the disclosure. However, it is understood that this disclosure may be practiced without these specific details. For instance, this disclosure refers to maintaining a curvature of a curve section of a wellbore based on a curvature setpoint until an attitude setpoint is achieved in illustrative examples. Aspects of this disclosure can be also applied to maintaining a curvature of a curve section of a wellbore based on a curvature setpoint for a specified time or depth drilled. As another example, embodiments are not limited to a lookup table for storing associations of control gains with different drilling operation parameters measurements. Embodiments can use other data structures or hardware tables to map control gains to drilling operation parameters measurements. In other instances, well-known instruction instances, protocols, structures, and techniques have not been shown in detail in order not to obfuscate the description.

Overview

A wellbore may have vertical, tangent, or horizontal sections that are connected by a curve section. When drilling the curve section, the tool face orientation of the drilling bottom hole assembly ("BHA") should be oriented correctly for the wellbore path/trajectory to adhere to a planned wellbore trajectory. Due to the varying drilling condition, adjustments to steering inputs are needed to maintain the wellbore trajectory within range of the planned wellbore trajectory.

A curvature cruise controller has been created to automatically maintain a specified target curvature to drill the curve section of a wellbore trajectory. Setpoints in terms of curvature and attitude setpoints are input to the curvature cruise controller algorithm. The curvature cruise controller may use a linear quadratic regulator ("LQR") controller or other suitable model-based controllers to regulate the instantaneous wellbore curvature to achieve the specified curvature setpoint while attempting to reach the desired attitude setpoint once the curve section is complete. The LQR controller generates steering inputs (e.g., tool face orientation and duty cycle) to be applied to a drilling tool. During drilling of the curve section, the curvature cruise controller receives attitude feedback and calculates curvature and attitude errors with respect to specified curvature and attitude setpoints. Next, the LQR controller sets curvature and attitude errors as system states and utilizes a wellbore propagation model and drilling operation parameters feedback to compute control gains and to update steering inputs. The steering input updates facilitate maintaining the curvature with respect to the specified setpoints. The curvature cruise controller also includes a gain tuning function that generates (quasi) real-time control gains based on drilling operation parameters feedback.

Example Illustrations

Figure 1:
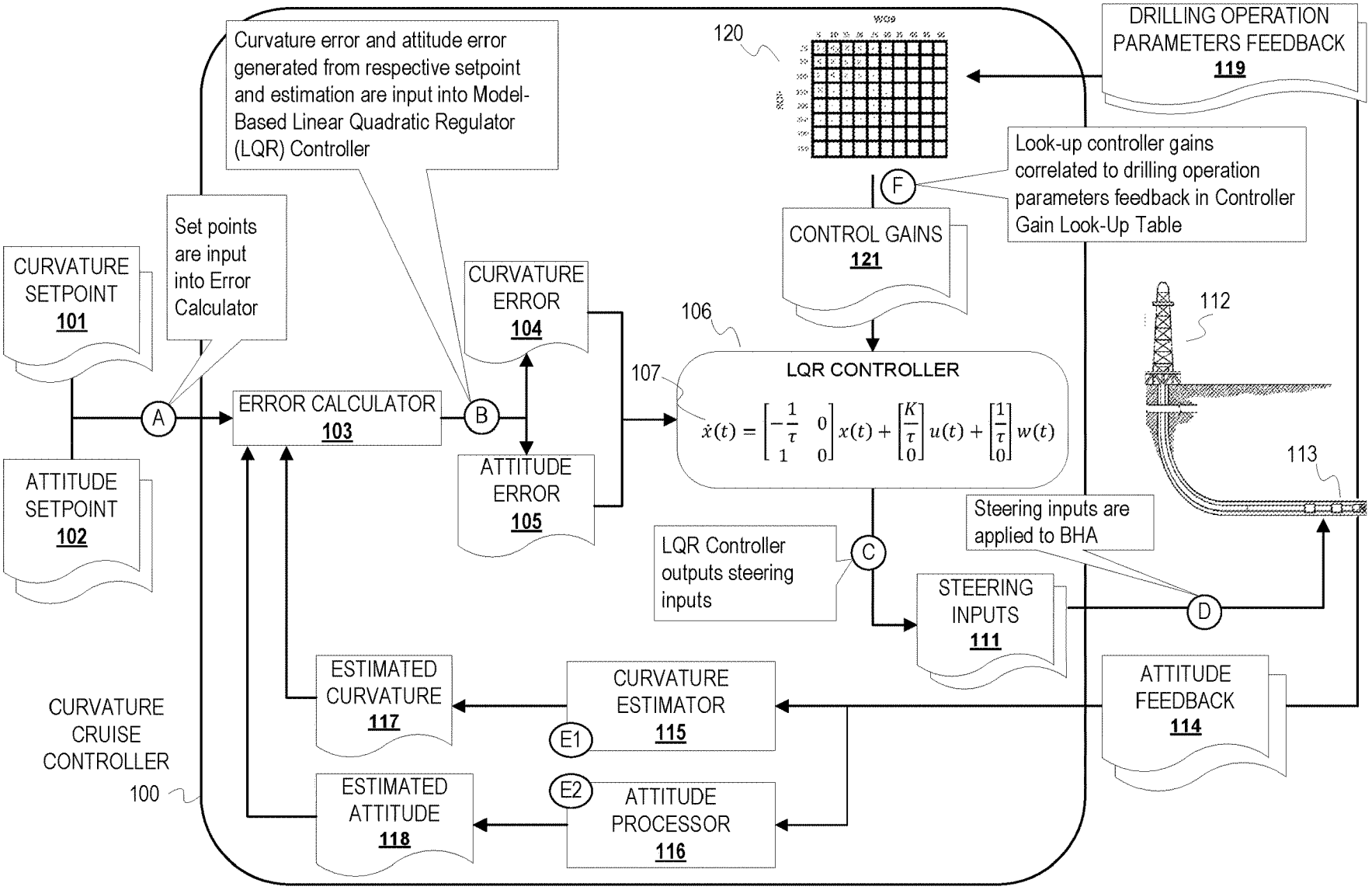
FIG. 1 is a conceptual diagram of a curvature cruise controller that maintains the desired wellbore curvature when drilling a curve section of a wellbore.

FIG. 1 is a conceptual diagram of a curvature cruise controller that maintains the desired wellbore curvature when drilling a curve section of a wellbore. A curvature cruise controller 100 is a component of a drilling system or in communication with a drilling system (e.g., drilling/steering software that controls a drill bit, drilling assembly, and/or drill string). The curvature cruise controller 100 includes an LQR controller 106 configured with a wellbore propagation model 107. Although FIG. 1 shows the curvature cruise controller 100 including an LQR controller, other implementations may include any suitable controller type (e.g., any suitable model-based controller). The LQR controller 106 generates steering inputs 111 to regulate the instantaneous curvature and attitude of the wellbore to desired curvature setpoint 101 and attitude setpoint 102, respectively. The illustration depicts two feedback loops that communicate inputs for the LQR controller 106. The first feedback loop communicates estimated curvature 117 and estimated attitude 118 to error calculator 103 to calculate curvature error 104 and attitude error 105 respectively, which are then used as inputs for LQR controller 106. A control gain tuning loop communicates tuned control gains 121 to the LQR controller 106 via a lookup table 120. The illustration depicts a drilling system 112 that comprises a BHA 113. Embodiments are not limited to a particular arrangement of a BHA 113. The steering inputs 111 can be used to control various tools (e.g., steerable positive displacement motor, and rotary steerable systems). The steering inputs 111 are communicated (directly or indirectly) to the BHA 113. Measurements taken by sensors placed on the BHA 113, after the steering inputs 111 have been implemented, can be communicated to the two feedback loops asynchronously to generate new steering inputs 111 and maintain the desired curvature for a curve section. The controller depicted in FIG. 1 can be applied to surface operations and downhole operations.

FIG. 1 is annotated with a series of letters A-F. These letters represent stages of operations, each of which can be one or multiple operations. Although these stages are ordered for this example, the stages illustrate one example to aid in understanding this disclosure and should not be used to limit the claims. Subject matter falling within the scope of the claims can vary with respect to the order and some of the operations.

At stage A, curvature setpoint 101 and attitude setpoint 102 are defined and input into error calculator 103. The curvature setpoint 101 is the target curvature of the curve section of the wellbore. The attitude setpoint 102 comprises the target attitude (inclination setpoint and/or azimuth setpoint) of the wellbore. Both curvature and attitude setpoints can be determined by the well plan or desired curvature specified by the user. For example, if there is a lateral section following a curve section, the attitude setpoint 102 may have a value of 90 degrees (indication of the end of the curve) if not otherwise specified by the well plan or user.

At stage B, curvature error 104 and attitude error 105 are calculated by the error calculator 103 and input into LQR controller 106. After attitude feedback 114 is received, the outputs of estimated curvature 117 and estimated attitude 118 are communicated to error calculator 103. Curvature error 104 and attitude error 105 ("errors") are calculated by error calculator 103 based on the respective setpoints and estimations. These errors 104, 105 represent the current system state to the LQR controller 106.

At stage C, the LQR controller 106 computes and outputs steering inputs 111. For an initial state, a set of default gains can be used as input to the LQR controller 106. After the BHA 113 produces drilling operation parameters feedback 119, the selection of control gains is triggered, and the new control gains are incorporated into the computation of the steering inputs 111. The LQR controller 106 comprises a wellbore propagation model 107 that characterizes the drilling tool's response dynamics.

At stage D, steering inputs 111 are applied to BHA 113 to regulate the curvature and attitude to the curvature setpoint 101 and attitude setpoint 102 to keep the wellbore trajectory within range of the desired curvature and attitude.

At stages E1 and E2, a curvature estimator 115 and an attitude processor 116 respectively generate estimated curvature 117 (depicted as stage E1) and process estimated attitude 118 (depicted as stage E2) based on attitude feedback measurement 114. For FIG. 1, attitude feedback 114 includes components of attitude (e.g., inclination and azimuthal measurements). The attitude processor 116 provides estimated attitude 118 from these components correlated by time stamps. In some cases, the sensors or sensor package of the BHA 113 will provide estimated attitude 118 without further processing. Attitude feedback 114 is input into curvature estimator 115 to generate estimated curvature 117. Estimated curvature 117, which corresponds to the estimation of instantaneous curvature of the wellbore is input into error calculator 103 to generate curvature error 104 with respect to curvature setpoint 101. Attitude feedback 114 are also input into attitude processor 116 to compute or filter raw attitude measurements and generate estimated attitude 118. Estimated attitude 118, which corresponds to the instantaneous attitude of the wellbore is input into error calculator 103 to generate attitude error 105 with respect to attitude setpoint 102.

At stage F, control gains 121 are selected from the control gain lookup table 120 based on the drilling operation parameters measurements. The selected control gains 121 are then given to the LQR controller 106. Drilling operation parameters measurements can include but are not limited to, rate of penetration ("ROP") and weight on bit ("WOB), in this example. Control gain lookup table 120 comprises predetermined control gains that have been designed offline for different combinations of the drilling operation parameters measurements based on the wellbore propagation model 107 and BHA 113 configurations. Based on the drilling operation parameters feedback 119, the control gains 121 ("control gain vector") are queried from the control gain lookup table and then input to the LQR controller 106.

Figure 2:
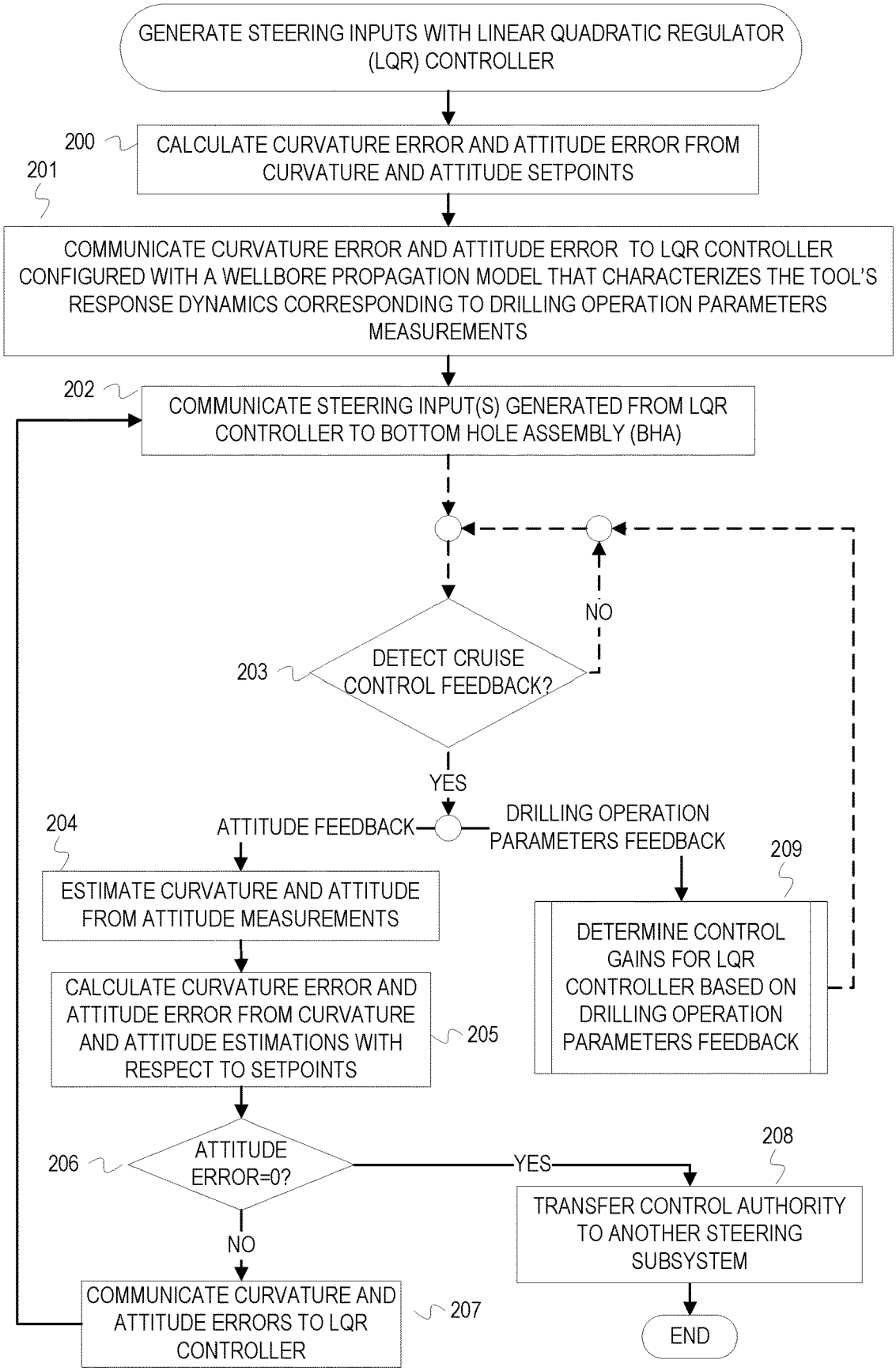
FIG. 2 is a flowchart including examples of operations to generate steering inputs with a model-based controller.

FIG. 2 is a flowchart including examples of operations to generate steering inputs with a model-based controller. The example operations in FIG. 2 are described with reference to a curvature cruise controller, which can be implemented as a subsystem of the drilling system or in communication with a drilling system. The operations of FIG. 2 can be applied to two-dimensional and three-dimensional control scenarios. For example, in a two-dimensional scenario, the controller can hold a constant azimuth and build the curve (increasing the inclination) or drop the curve (decreasing the inclination) according to a specified curvature setpoint in the inclination plane. As mentioned before, the curvature cruise controller can be implemented both on the surface and downhole, using surface and/or downhole data.

At block 200, the curvature cruise controller first calculates a curvature error and an attitude error based on curvature and attitude setpoints. The curvature setpoint and attitude setpoint can be determined based on a well plan or defined by a user. The curvature setpoint can be stated in depth or time domain. For example, the user could specify the curvature setpoint to be 10 degrees/100 ft. The curvature setpoint can vary throughout the curve section. For example, a user can specify a change in curvature setpoint to 12 degrees/100 ft from 10 degrees/100 ft after a certain measured depth or time is achieved, a certain inclination is achieved, the ROP has changed, or there is an unexpected change in the formation resulting in altering the planned well path. The attitude setpoint can be stated in degrees. For example, a directional driller can set the attitude setpoint to an azimuth of 180 degrees and an inclination of 75 degrees if they want the curve section to be drilled in the direction of 180 degrees until a 75-degree inclination is achieved. Like the curvature setpoint, the attitude setpoint can vary with respect to depth/location and/or time throughout the curve section. For example, the directional drilling system can specify the curve be drilled at an azimuth of 225 degrees from 180 degrees after a certain depth is achieved, after a certain time period, or there is an unexpected change in the formation resulting in altering the planned well path.

Curvature error and attitude error ("errors") can be calculated from their respective setpoints and quasi-real-time curvature estimation and attitude measurements. The mentioned curvature and attitude errors can be defined as difference between the setpoints and the respective estimated curvature and attitude measurements obtained from sensors placed on the BHA. For example, if the estimated instantaneous curvature is 12 degrees/100 ft and the curvature setpoint is 10 degrees/100 ft, then the curvature error is 2 degrees/100 ft. As another example, the attitude measurement sensor indicates the instantaneous inclination to be 80 degrees and the inclination setpoint is 85 degrees, the attitude error is 5 degrees.

At block 201, the curvature cruise controller communicates curvature error and attitude error to a model-based controller, such as an LQR controller. Such a controller is configured with a wellbore propagation model that characterizes the tool's response dynamics. The model-based controller utilizes the wellbore propagation model and generates steering inputs in terms of duty cycle (i.e., steering ratio) and tool face orientation (i.e., the angle in which the drill bit faces with respect to the BHA) to achieve desired curvature and attitude setpoints. The model-based controller (such as an LQR controller) can be configured with the following example of a wellbore propagation model:

$$\dot{x}(t) = \begin{bmatrix} -\frac{1}{\tau} & 0 \\ 1 & 0 \end{bmatrix} x(t) + \begin{bmatrix} \frac{K}{\tau} \\ 0 \end{bmatrix} u(t) + \begin{bmatrix} \frac{1}{\tau} \\ 0 \end{bmatrix} w(t). \quad \text{(Equation 1)}$$

The model-based controller may be configured with other model representations and is not limited to the example wellbore propagation model. The wellbore propagation model (Equation 1) maps the drilling system's input to an output response ("tool's response dynamics"). The model parameters of wellbore propagation model (Equation 1) can be calibrated based on feedback measurements as drilling proceeds. Calibrating model parameters facilitates the wellbore propagation model (Equation 1) to better capture the change in drilling conditions such as the tool's response dynamics or formation properties. Equation 1 can explain the dynamics of tool's response in both the inclination and azimuthal plane in time domain. Without loss of generality, the wellbore propagation model representation (Equation 1) can also be in depth domain. $\tau$ denotes the time constant (response time) of the dynamics in seconds. K denotes the maximum curvature generation capabilities of the BHA (in both inclination and azimuth) in degrees/second. Model parameters and K of the wellbore propagation model may depend on factors including, but not limited to, the BHA configuration, formation properties, and drilling operation parameters measurements. For example, model parameters for a wellbore propagation model for a BHA with a first drill bit drilling in a first formation will differ from the model parameters for a BHA with a second drill bit in a second formation. Moreover, model parameters of the wellbore propagation model (Equation 1) may take different values in inclination and azimuth planes.

The system state vector of the mentioned wellbore propagation model or state space model (Equation 1) is represented by x(t), where the system state vector can be $$x(t) = \begin{bmatrix} \kappa_\phi \\ \phi \end{bmatrix} \text{ or } x(t) = \begin{bmatrix} \kappa_\phi \\ \phi \end{bmatrix}$$

for inclination and azimuth, where $\theta$ and $\phi$ are the wellbore inclination and azimuth in degrees, respectively. $\kappa_\theta=\dot{\theta}$ is the inclination variation rate (also referred to as curvature or build rate) and $\kappa_\phi=\dot{\phi}$ is azimuth change rate (also referred to as walk rate) in degrees/second (deg/sec). The integral of the curvature error, $\zeta(t)=\int\kappa_{set}-\kappa$, can be augmented into the system state vector to facilitate the LQR controller to track the arbitrary non-zero curvature reference command.

The control input of the wellbore propagation model is represented by u(t), where $u=u_\theta$, $u_\phi\in[-1, 1]$ in inclination or azimuth planes, respectively. w(t) represents unmodeled dynamics, uncertainties, bias, or disturbances from formations. The disturbance term can capture known dynamical bias such as formation push and gravity effects. The disturbance term is configured based on domain knowledge and (quasi) real time data.

The LQR controller implemented in the curvature cruise controller is configured with the wellbore propagation model to maintain a specified curvature setpoint. The LQR controller design is a technique in which a general linear state-space dynamic model representation is utilized and represented by:

$$\dot{x}=Ax+Bu \quad \text{(Equation 2)},$$

where A and B are the system's state-space real-values matrices. The wellbore propagation model represents the linear state-space model in the LQR controller. The control input designed by the LQR controller takes the full-state feedback form as follows:

$$u(t)=-Kx(t) \quad \text{(Equation 3)},$$

where K is the optimal control gain vector. A control gain matrix is computed and/or designed in advance that correlates control gain vectors with different combinations of values for drilling operation parameters (i.e., different system operating conditions). The correlations of control gain vector can be with combinations of individual values of drilling operation parameters or ranges. This allows gain changes to be limited to those in response to changes in system operating conditions outside of ranges (e.g., tolerating small changes in system operating conditions) which can reduce gain switching. In addition, the look-up table can occupy less memory. The full-state feedback information, x(t), of Equation 3 can be either measured directly, observed, or estimated. By designing the optimal control vector K, the LQR controller minimizes the performance index:

$$J = \int_0^\infty (x^T Qx + u^T Ru)dt, \quad \text{(Equation 4)}$$

where Q and R are positive-definite real matrices being utilized as penalty factors of the performance index. These penalty factors can be chosen based on the preference and knowledge of the user(s) of the curvature cruise controller. Q and R denote the importance, or aggressiveness, of the system states and the control input, respectively. The optimal full-state feedback control law is chosen to minimize the performance index and is given by:

$$u(t)=-Kx(t)=-R^{-1}B^TPx(t) \quad \text{(Equation 5)},$$

where P is a positive-definite Hermitian or real matrix which should satisfy the Riccati equation:

$$A^TP+PA-PBR^{-1}B^TP+Q=0 \quad \text{(Equation 6)}.$$

The LQR controller is an infinite horizon design, and the optimal control gain matrix K is constant throughout the horizon.

The optimal full-state feedback control law of the LQR controller will generate the steering input(s) based on the curvature error and attitude error input into the LQR controller and the control gain vector selected based on current drilling operation parameters. Examples of steering inputs or steering recommendations include tool face orientation and the duty cycle (steering ratio). The steering inputs may be communicated to the BHA to carry out the drilling process.

At block 202, the curvature cruise controller communicates the steering input(s) generated from the LQR controller to the BHA. If the curvature cruise controller is located at the surface, the steering inputs can be downlinked to the BHA through a telemetry system to carry out the drilling process. If the curvature cruise controller is located on the BHA downhole, the steering input(s) can be communicated via memory/storage, inter-process communication, etc., to the BHA to carry out the drilling process.

At block 203, the curvature cruise controller determines whether cruise control feedback is detected. Cruise control feedback can be either or both attitude feedback and drilling operation parameters feedback. If no feedback is detected, then operational flow returns to 203. The curvature cruise controller may monitor a memory area or storage location for feedback according to a schedule. Interrupts can be generated when feedback is received. Regardless of the detection technique, the attitude feedback, and drilling operation parameters feedback may be delivered/received asynchronously. For example, attitude feedback may be detected every 2 minutes and drilling operation parameters feedback may be detected every 4 minutes. The curvature cruise controller may generate errors for generating steering input(s) with the current LQR controller in response to each detected attitude feedback. When no attitude feedback is detected, the curvature cruise controller does not generate new steering inputs. Embodiments that deliver steering inputs periodically may repeat steering inputs if no attitude feedback has been received since the previous steering inputs were generated but the steering system is programmed to expect steering input after expiration of a time interval measure from receipt of steering input. If the cruise control feedback includes attitude feedback, then operational flow continues to block 204. If the cruise control feedback includes drilling operation parameters feedback, then operational flow continues to block 209. These different paths of execution may proceed in parallel, assuming both types of feedback are detected. Embodiments may delay the delivery of errors to the LQR controller until updating of the well propagation model based on the drilling operation parameters feedback if both attitude and drilling operation parameters feedback are detected.

At block 204, the curvature cruise controller estimates real time curvature and attitude from attitude feedback. Attitude feedback may be directly observed/measured attitude or inclination and azimuth correlated by time. The attitude feedback may be preprocessed (e.g., filtered, aggregated, etc.) prior to the computation of the estimations. The estimated curvature can be generated by various methods. For example, the curvature cruise controller can calculate the difference between the quasi-real-time inclination and the inclination from the previous directional measurement. If the current/quasi-real-time inclination measurement is 75 degrees at 7,700 ft and the previous inclination measurement was 65 degrees at 7,600 ft, then the estimated curvature would be 10 degrees/100 ft.

At block 205, the curvature cruise controller calculates curvature error from the estimated curvature and attitude error from the processed attitude measurement. The curvature cruise controller calculates the errors with respect to the setpoints. Curvature and attitude setpoints can be changed throughout the drilling operation. The curvature error is the difference between the estimated curvature and the curvature setpoint. For example, if the estimated curvature is 12 degrees/100 ft and the curvature setpoint is 10 degrees/100 ft, then the curvature error is 2 degrees/100 ft. Similarly, the attitude error is the difference between the attitude measurement and the attitude setpoint. For example, if the quasi-real-time attitude measurement is 99 degrees and the attitude setpoint is 90 degrees, then the attitude error is 9 degrees. If either of the setpoints varies from the initial setpoints, then the most current setpoint would be used.

At block 206, the curvature cruise controller determines if the attitude error is zero. An attitude error of zero indicates that the wellbore has reached its attitude setpoint. If the curvature cruise controller determines that the attitude error is zero, operations proceed to block 208. Otherwise, operations proceed to block 207.

At block 207, the curvature and attitude errors are communicated to the LQR controller to generate new steering input(s). The curvature error can be zero, therefore if different control gains for the LQR controller have not been selected, the steering input(s) output by the LQR controller will indicate no steering change. After communicating the errors to the LQR controller, the LQR controller generates steering inputs which are communicated to the BHA (i.e., the operational flow returns to block 202).

At block 208, the curvature cruise controller will transfer control authority to another subsystem after completing a curve section and/or reaching the target. For example, once the attitude setpoint is achieved, the curve section can be deemed complete and the wellbore can transition to a vertical, tangent, or horizontal section. This transfer can be to manual drilling or another automated drilling subsystem. If the curvature cruise controller is implemented as distinct from the drilling system but in communication with the drilling system, then the curvature cruise controller can generate a notification to the drilling system that the curve section has been completed.

At block 209, the curvature cruise controller determines control gains for the LQR controller based on drilling operation parameters feedback. Drilling operation parameters feedback includes, but is not limited to, WOB and/or ROP which are used to determine the control gains via a lookup table. This control gain determination is illustrated with example operations in FIG. 3.

Figure 3:
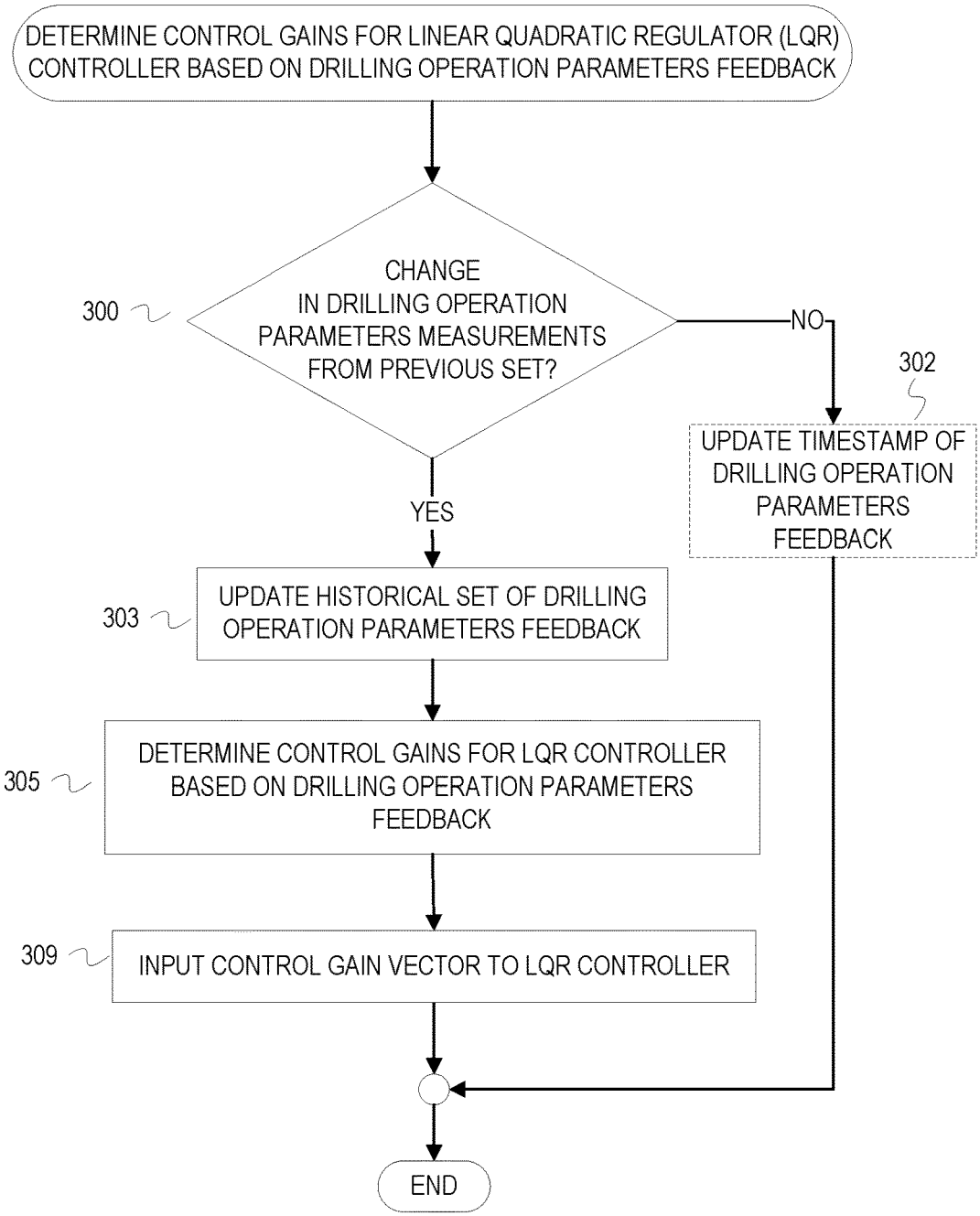
FIG. 3 is a flowchart including examples of operations to determine control gains for an LQR controller based on drilling operation parameters feedback.

FIG. 3 is a flowchart including examples of operations to determine control gains for an LQR controller based on drilling operation parameters feedback. The example operations in FIG. 3 are described with reference to a curvature cruise controller for consistency with the earlier example illustrations.

At block 300, the curvature cruise controller detects if there has been a change in drilling operation parameters feedback from the previous drilling operation parameters feedback. The curvature cruise controller is not limited to determining change based on a direct comparison of measurements between times. If the control gain lookup table correlates control gain vectors to ranges of measurements, then detection of a change in drilling operation parameters feedback would be determining whether measurements in current drilling operation parameters feedback falls within a different range as defined by the control gain lookup table than a preceding drilling operation parameters feedback. If the curvature cruise controller detects a change in drilling operation parameters feedback, operational flow proceeds to block 303. Otherwise, operational flow proceeds to block 302.

At block 302, the curvature cruise controller updates a timestamp of the drilling operation parameters feedback to track receipt of drilling operation parameters feedback despite it being repeated feedback from previous feedback. Tracking timestamps of drilling operation parameters feedback may be used for evaluation of a drilling operation, for example validating that drilling measurements are being provided on schedule. Tracking the time of the feedback is optional.

At block 303, the curvature cruise controller updates the historical set of drilling operation parameters feedback. The curvature cruise controller maintains a history of drilling operation parameters feedback for at least one preceding time for comparison of drilling operation parameters feedback. If there has been no change in drilling operation parameters feedback, then there is no tuning to be performed.

At block 305, the curvature cruise controller queries the control gain lookup table with the drilling operation parameters measurements (e.g., WOB and ROP) in the drilling operation parameters feedback to obtain control gains. Predetermined control gains are stored in a lookup table and indexed or referenced by a combination of values/measurements of drilling operation parameters. For example, if the real-time ROP was 200 feet (ft)/hour and the real-time WOB was 100,000 pounds (lbs.), then a predetermined control gains vector at an ROP of 200 ft/hour and a WOB of 100,000 lbs in the lookup table would be selected. Control gains can be associated with intervals or ranges of measurements for the drilling operation parameters to avoid frequent controller gain switching. For example, the lookup table can correlate control gain vectors with a range of WOB values from 25,000 lbs to 350,000 lbs in 25,000 lbs intervals. If the drilling operation parameters feedback includes a WOB value that falls between the intervals, the curvature cruise controller can interpolate the control gains based on the surrounding intervals of the WOB value. The number of intervals can depend on the memory available. The LQR control gain vector, $\hat{K}$, can be represented as shown in Equation 7.

$$\hat{K}=[K_1,K_2,K_I] \quad \text{(Equation 7).}$$

Each control gain of the control gain vector corresponds to a different state parameter considered by the LQR controller. As an example, a control gain vector can include a control gain for each curvature state, attitude state, and curvature error.

At block 309, the curvature cruise controller inputs the control gain vector into the LQR controller to update the control input. The curvature cruise controller may pass the control gain vector to the LQR controller by calling a function/method that passes the control gain vector as an argument for computation of the control input according to the LQR controller. The optimal full-state feedback control input is computed as represented below:

$$u(t)=-\hat{K}x_s(t)=-K_1\cdot\kappa(t)-K_2\cdot x_2(t)+K_I\cdot\zeta(t) \quad \text{(Equation 8),}$$

where $\kappa(t)$ is curvature state of the system (build rate, $\kappa_\theta$, in inclination plane dynamics, or walk rate, $\kappa_\phi$, in azimuth plane dynamics), $x_2(t)$ denotes attitude state of the system (inclination $\theta$, or azimuth $\phi$), and $\zeta(t)$ is the integral of curvature error, which is introduced to enable the introduced curvature cruise controller with arbitrary non-zero curvature setpoint tracking capability. As depicted, the control input is computed to account for current system state as represented by the current system state vector $x_s(t)$ which includes the state components/parameters curvature state, attitude state, and curvature error. Equation 8 also shows that the control input accounts for current operating system conditions (i.e., current drilling operation parameters feedback) as expressed by the control gains. Equation 8 provides a control input in the inclination plane (e.g., build rate effort) and a control input in the azimuth plane (e.g., walk rate effort). Generation of duty cycle and tool face orientation based on build rate effort and walk rate effort will be discussed in FIG. 5.

Embodiments do not necessarily track changes in drilling operation parameters feedback and can instead train history of gains. Embodiments can query the control gain lookup table with measurements in the drilling operation parameters feedback and determine whether the resulting control gains are different than those previously input to the LQR controller for computation of the control signal or control input u(t). If the control gains have changed, then the new control gains are input to the LQR controller.

The flowcharts are provided to aid in understanding the illustrations and are not to be used to limit the scope of the claims. The flowcharts depict example operations that can vary within the scope of the claims. Additional operations may be performed; fewer operations may be performed; the operations may be performed in parallel, and the operations may be performed in a different order. For example, the operations depicted in blocks 203-209 of FIG. 2 can be performed in parallel or concurrently. It will be understood that each block of the flowchart illustrations and/or block diagrams, and combinations of blocks in the flowchart illustrations and/or block diagrams, can be implemented by program code. The program code may be provided to a processor of a general-purpose computer, special-purpose computer, or other programmable machine or apparatus.

As will be appreciated, aspects of the disclosure may be embodied as a system, method, or program code/instruction stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of the platforms (operating system and/or hardware), application ecosystem, interfaces, programmer preferences, programming language, administrator preferences, etc.

Any combination of one or more machine readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object-oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

Figure 4:
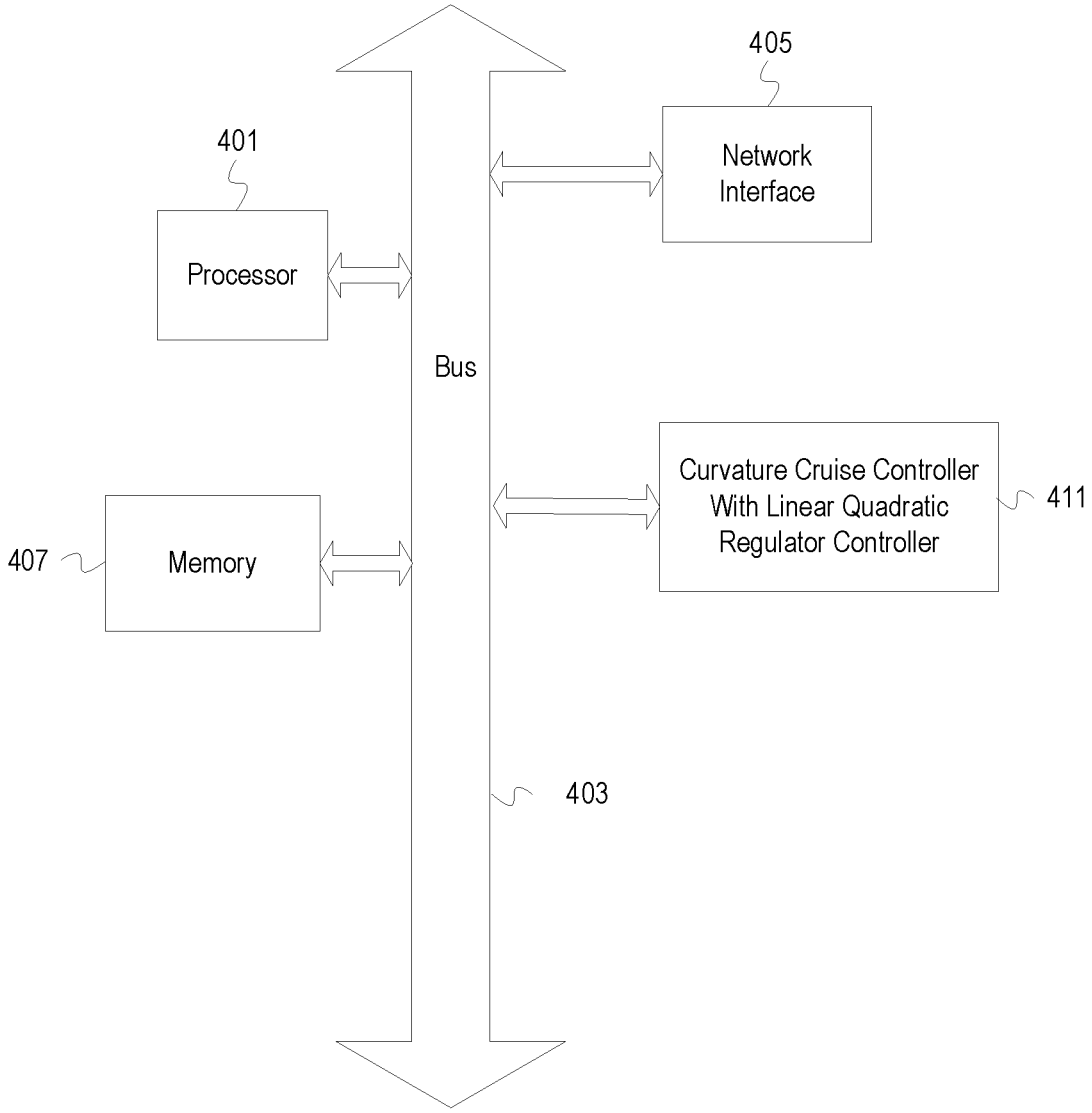
FIG. 4 depicts an example computer system with a curvature cruise controller.

FIG. 4 depicts an example computer system with a curvature cruise controller. The computer system includes a processor 401 (possibly including multiple processors, multiple cores, multiple nodes, and/or implementing multi-threading, etc.). The computer system includes memory 407. The memory 407 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer system also includes a bus 403 (e.g., PCI, ISA, PCI-Express, HyperTransport® bus, InfiniBand® bus, NuBus, etc.) and a network interface 405 (e.g., a Fiber Channel interface, an Ethernet interface, an interne small computer system interface, SONET interface, wireless interface, etc.). The system also includes curvature cruise controller 411 with a linear quadratic regulator controller. As stated above, the model is a wellbore propagation model. The curvature cruise controller 411 maintains a specified curvature for a curve section of a wellbore using attitude feedback to recompute errors and adjust steering inputs while also using drilling operation parameters feedback to select control gains that affect computation of control input by the LQR controller. Any one of the previously described functionalities may be partially (or entirely) implemented in hardware and/or on the processor 401. For example, the functionality may be implemented with an application specific integrated circuit, in logic implemented in the processor 401, in a co-processor on a peripheral device or card, etc. Further, realizations may include fewer or additional components not illustrated in FIG. 4 (e.g., video cards, audio cards, additional network interfaces, peripheral devices, etc.). The processor 401 and the network interface 405 are coupled to the bus 403. Although illustrated as being coupled to the bus 403, the memory 407 may be coupled to the processor 401.

Figure 5:
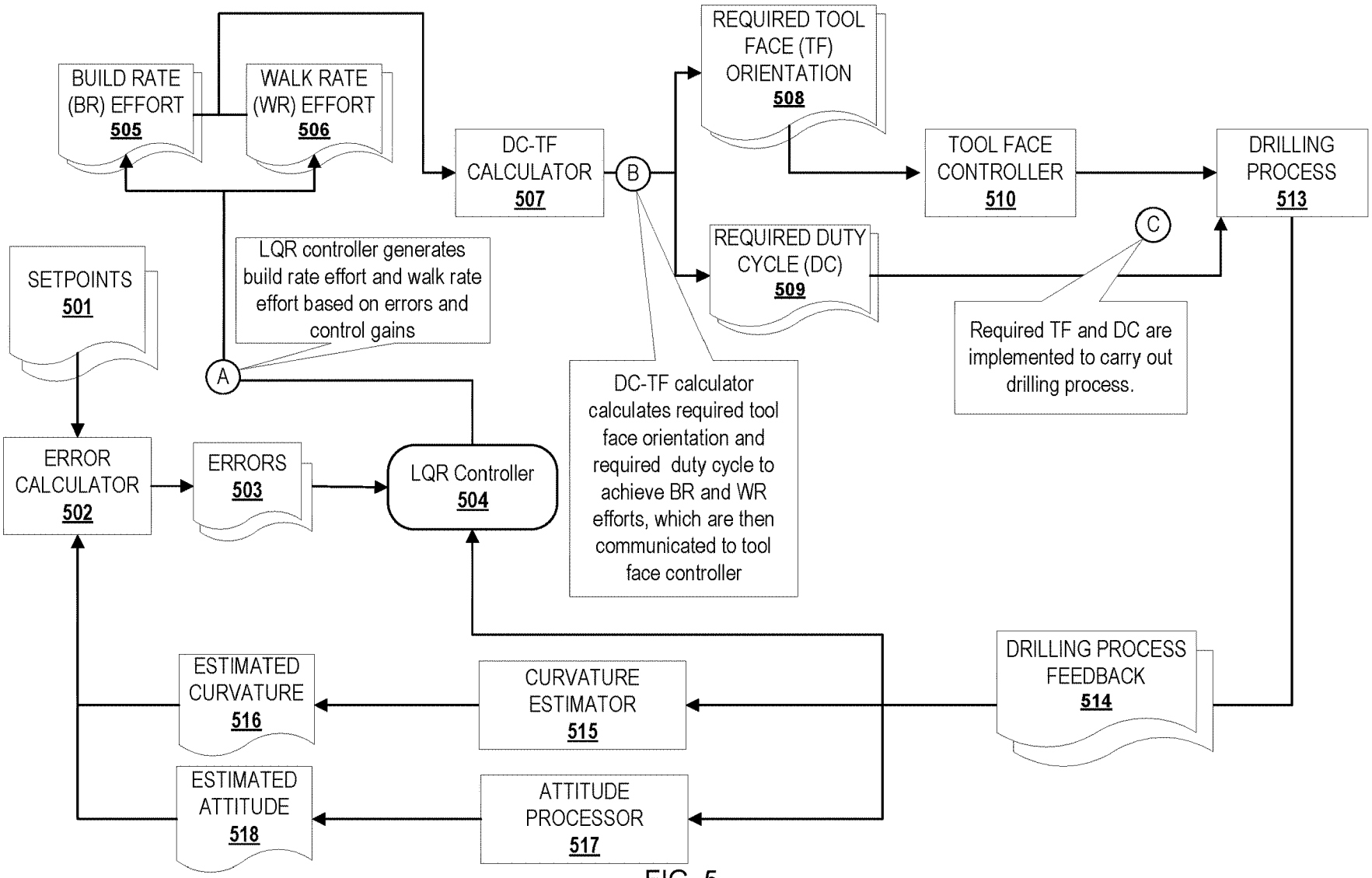
FIG. 5 is a conceptual diagram of an LQR controller generating steering inputs for implementation into a drilling process.

FIG. 5 is a conceptual diagram of an LQR controller generating steering inputs for implementation into a drilling process. Steering decisions are generated by the control input of the well propagation model within the LQR controller 504. Steering inputs may include required tool face orientation 508 and required duty cycle 509 that can be determined based on build rate effort 505 and walk rate effort 506 generated by the LQR controller 504. FIG. 5 is annotated with letters A-C to indicate states of operation. These letters represent stages of operations, each of which can be one or multiple operations. Although these stages are ordered for this example, the stages illustrate one example to aid in understanding this disclosure and should not be used to limit the claims. Subject matter falling within the scope of the claims can vary with respect to the order and some of the operations.

At stage A, the LQR controller 504 generates build rate ("BR") effort 505 and walk rate ("WR") effort 506 based on errors 503 and control gain vectors corresponding to drilling process feedback 514. Errors 503, calculated by error calculator 502, are based on setpoints 501 (e.g., curvature and attitude setpoints), estimated curvature 516 (generated with attitude measurements in drilling process feedback 514 by curvature estimator 515), and estimated attitude 518 (generated from attitude measurements in drilling process feedback 514 by attitude processor 517). Build rate effort 505 comprises the build rate (i.e., the rate at which the wellbore builds in the vertical plane) required by the BHA to minimize errors 503 at current drilling operation parameters measurements, such as ROP and WOB. Likewise, walk rate effort 506 comprises the walk rate (i.e., the rate at which the wellbore builds in the horizontal plane) required by BHA to minimize errors 503 at current drilling operation parameters measurements.

At stage B, DC-TF Calculator 507 generates required tool face orientation 508 and required duty cycle 509 based on build rate effort 505 and walk rate effort 506. Tool face orientation 508 comprises the angle in which the drill bit faces with respect to the BHA. The required duty cycle/steering ratio 509 comprises the amount of steering force needed from the BHA. Together, the required tool face orientation and duty cycle aim to achieve the build rate and walk rate efforts to minimize errors 503. Duty cycle can be represented as a percentage of the maximum steering capability of the tool. For example, 100% duty cycle would mean full steering capabilities of the BHA are needed to achieve the build rate and walk rate efforts. Required tool face orientation 508 is communicated to tool face controller 510. Tool face controller 510 may be located on the BHA. Required duty cycle 509 can be communicated directly to the drilling process 513. The required tool face orientation 508 and required duty cycle 509 can be downlinked to the tool face controller 510 and drilling process 513, respectively, if generated on surface or implemented directly into the tool face controller 510 and drilling process 513 if generated downhole.

At stage C, tool face controller 510 implements the steering inputs to carry out the drilling process 513. Drilling process 513 can generate drilling process feedback 514 (i.e., drilling operation parameters feedback and attitude feedback) to assist in the next cycle of steering inputs generation.

While the aspects of the disclosure are described with reference to various implementations and exploitations, it will be understood that these aspects are illustrative and that the scope of the claims is not limited to them. In general, techniques for maintaining a constant curvature for a curve section of a wellbore as described herein may be implemented with facilities consistent with any hardware system or hardware systems. Many variations, modifications, additions, and improvements are possible.

Terminology

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Embodiment 1: A method comprising for each of at least a subset of a plurality of attitude feedback obtained during drilling, calculating a curvature error with respect to a curvature setpoint and an attitude error with respect to an attitude setpoint based, at least in part, on the attitude feedback; and inputting the curvature error and the attitude error into a model-based controller, which is configured with a wellbore propagation model, to obtain steering inputs; for each of at least a subset of a plurality of drilling operation parameters feedback obtained during drilling, accessing a control gain table with measurements in the drilling operation parameters feedback to obtain a predetermined control gain vector, wherein the control gain table correlates control gain vectors to different combinations of drilling operation parameters measurements; and inputting the predetermined control gain vector to the model-based controller to obtain a control input that includes steering inputs; and communicating the steering inputs to influence the drilling at least through a curve section of a wellbore trajectory.

Embodiment 2: The method of Embodiment 1, wherein at least one of the curvature setpoint and the attitude setpoint varies during drilling.

Embodiment 3: The method of any one of Embodiments 1-2 further comprising, for each of at least the subset of attitude feedback obtained during drilling, estimating curvature based, at least in part, on the attitude feedback, wherein calculating the curvature error is based on the estimated curvature with respect to the curvature setpoint.

Embodiment 4: The method of any one of Embodiments 1-3, wherein attitude feedback at least comprises inclination and azimuth correlated by time.

Embodiment 5: The method of any one of Embodiments 1-4, wherein the drilling operation parameters feedback comprise measurements of weight-on-bit and rate-of-penetration.

Embodiment 6: The method of any one of Embodiments 1-5, wherein the control gain table correlates a plurality of control gain vectors to combinations of a plurality of the drilling operation parameters measurements and BHA configurations.

Embodiment 7: The method of any one of Embodiments 1-6, wherein the model-based controller comprises a linear quadratic regulator controller.

Embodiment 8: The method of any one of Embodiments 1-7, wherein the steering inputs comprise duty cycle and tool face orientation.

Embodiment 9: The method of any one of Embodiments 1-8 further comprising determining whether the predetermined control gain vector is different than a second predetermined control gain vector obtained based on a preceding drilling operation parameters feedback, wherein inputting the predetermined control gain vector is based on determining that the predetermined control gain vector is different than the second predetermined control gain vector.

Embodiment 10: A non-transitory machine-readable medium having program code, the program code comprising instructions to, based on detection of attitude measurements and drilling operation parameters measurements from drilling of a wellbore trajectory that includes at least one curve section, calculate a curvature error with respect to a curvature setpoint and an attitude error with respect to an attitude setpoint based, at least in part, on the attitude measurements; select a predetermined control gain vector correlated to the drilling operation parameters measurements; and input the curvature error, the attitude error, and the predetermined control gain vector into a model-based controller, which is configured with a wellbore propagation model, to obtain steering inputs; and communicate the steering inputs to influence the drilling at least through the curve section of the wellbore trajectory.

Embodiment 11: The non-transitory machine-readable medium of Embodiment 10, wherein the program code further comprises instructions to estimate curvature based, at least in part, on the attitude measurements, wherein the instructions to generate the curvature error with respect to the curvature setpoint and the attitude error with respect to the attitude setpoint comprise instructions to generate the curvature error based on the estimated curvature with respect to the curvature setpoint and the attitude error based on the attitude measurements with respect to the attitude setpoint.

Embodiment 12: The non-transitory machine-readable medium of any one of Embodiments 10-11, wherein attitude measurements at least comprise measurements of inclination and azimuth correlated by time.

Embodiment 13: The non-transitory machine-readable medium of any one of Embodiments 10-12, wherein the drilling operation parameters measurements comprise measurements of weight-on-bit and rate-of-penetration.

Embodiment 14: The non-transitory machine-readable medium of any one of Embodiments 10-13, wherein the instructions to select the predetermined control gain vector correlated to the drilling operation parameters measurements comprise instructions to query a lookup table with the drilling operation parameters measurements, wherein the lookup table correlates a plurality of control gain vectors to combinations of measurements of a plurality of drilling operation parameters measurements.

Embodiment 15: The non-transitory machine-readable medium of any one of Embodiments 10-14, wherein the model-based controller comprises a linear quadratic regulator controller.

Embodiment 16: The non-transitory machine-readable medium of any one of Embodiments 10-15, wherein the steering inputs comprise duty cycles and tool face orientation.

Embodiment 17: The non-transitory machine-readable medium of any one of Embodiments 10-16, wherein the program code further comprises instructions to determine whether the predetermined control gain vector is different than a second predetermined control gain vector set within the model-based controller, wherein the instructions to input the predetermined control gain vector is based on a determination that the predetermined control gain vector is different than the second predetermined control gain vector.

Embodiment 18: An apparatus comprising a processor; a machine-readable medium comprising program code executable by the processor to cause the apparatus to, based on detection of attitude measurements and drilling operation parameters measurements from drilling of a wellbore trajectory that includes at least one curve section, generate a curvature error with respect to a curvature setpoint and an attitude error with respect to an attitude setpoint based, at least in part, on the attitude measurements; select a predetermined control gain vector correlated to the drilling operation parameters measurements; and input the curvature error, the attitude error, and the predetermined control gain vector into a model-based controller, which is configured with a wellbore propagation model, to obtain steering inputs; and communicate the steering inputs to influence the drilling at least through the curve section of the wellbore trajectory.

Embodiment 19: The apparatus of Embodiment 18, wherein the program code to select the predetermined control gain vector correlated to the drilling operation parameters measurements comprise instructions executable by the processor to cause the apparatus to query a lookup table with the drilling operation parameters measurements, wherein the lookup table correlates a plurality of control gain vectors to combinations of measurements of a plurality of drilling operation parameters measurements.

Embodiment 20: The apparatus of any one of Embodiments 18-19, wherein the program code to select the predetermined control gain vector correlated to the drilling operation parameters measurements comprise instructions executable by the processor to cause the apparatus to query a lookup table with the drilling operation parameters measurements, wherein the lookup table correlates a plurality of control gain vectors to combinations of ranges of measurements of a plurality of drilling operation parameters measurements.

What is claimed is:

1. A method comprising:

for each of at least a subset of a plurality of attitude feedback obtained during drilling, calculating a curvature error with respect to a curvature setpoint and an attitude error with respect to an attitude setpoint based, at least in part, on the attitude feedback; and inputting the curvature error and the attitude error into a model-based controller, which is configured with a wellbore propagation model, to obtain steering inputs;

for each of at least a subset of a plurality of drilling operation parameters feedback obtained during drilling, accessing a control gain table with measurements in the drilling operation parameters feedback to obtain a predetermined control gain vector, wherein the control gain table correlates control gain vectors to different combinations of drilling operation parameters measurements; and inputting the predetermined control gain vector to the model-based controller to obtain a control input that includes steering inputs; and communicating the steering inputs to influence the drilling at least through a curve section of a wellbore trajectory.

2. The method of claim 1, wherein at least one of the curvature setpoint and the attitude setpoint varies during drilling.

3. The method of claim 1 further comprising, for each of at least the subset of attitude feedback obtained during drilling, estimating curvature based, at least in part, on the attitude feedback, wherein calculating the curvature error is based on the estimated curvature with respect to the curvature setpoint.

4. The method of claim 1, wherein attitude feedback at least comprises inclination and azimuth correlated by time.

5. The method of claim 1, wherein the drilling operation parameters feedback comprise measurements of weight-on-bit and rate-of-penetration.

6. The method of claim 1, wherein the control gain table correlates a plurality of control gain vectors to combinations of a plurality of the drilling operation parameters measurements and BHA configurations.

7. The method of claim 1, wherein the model-based controller comprises a linear quadratic regulator controller.

8. The method of claim 1, wherein the steering inputs comprise duty cycle and tool face orientation.

9. The method of claim 1 further comprising determining whether the predetermined control gain vector is different than a second predetermined control gain vector obtained based on a preceding drilling operation parameters feedback, wherein inputting the predetermined control gain vector is based on determining that the predetermined control gain vector is different than the second predetermined control gain vector.

10. A non-transitory machine-readable medium having program code, the program code comprising instructions to:

based on detection of attitude measurements and drilling operation parameters measurements from drilling of a wellbore trajectory that includes at least one curve section, calculate a curvature error with respect to a curvature setpoint and an attitude error with respect to an attitude setpoint based, at least in part, on the attitude measurements;

select a predetermined control gain vector correlated to the drilling operation parameters measurements; and input the curvature error, the attitude error, and the predetermined control gain vector into a model-based controller, which is configured with a wellbore propagation model, to obtain steering inputs; and communicate the steering inputs to influence the drilling at least through the curve section of the wellbore trajectory.

11. The non-transitory machine-readable medium of claim 10, wherein the program code further comprises instructions to estimate curvature based, at least in part, on the attitude measurements, wherein the instructions to generate the curvature error with respect to the curvature setpoint and the attitude error with respect to the attitude setpoint comprise instructions to generate the curvature error based on the estimated curvature with respect to the curvature setpoint and the attitude error based on the attitude measurements with respect to the attitude setpoint.

12. The non-transitory machine-readable medium of claim 10, wherein attitude measurements at least comprise measurements of inclination and azimuth correlated by time.

13. The non-transitory machine-readable medium of claim 10, wherein the drilling operation parameters measurements comprise measurements of weight-on-bit and rate-of-penetration.

14. The non-transitory machine-readable medium of claim 10, wherein the instructions to select the predetermined control gain vector correlated to the drilling operation parameters measurements comprise instructions to query a lookup table with the drilling operation parameters measurements, wherein the lookup table correlates a plurality of control gain vectors to combinations of measurements of a plurality of drilling operation parameters measurements.

15. The non-transitory machine-readable medium of claim 10, wherein the model-based controller comprises a linear quadratic regulator controller.

16. The non-transitory machine-readable medium of claim 10, wherein the steering inputs comprise duty cycles and tool face orientation.

17. The non-transitory machine-readable medium of claim 10, wherein the program code further comprises instructions to determine whether the predetermined control gain vector is different than a second predetermined control gain vector set within the model-based controller, wherein the instructions to input the predetermined control gain vector is based on a determination that the predetermined control gain vector is different than the second predetermined control gain vector.

18. An apparatus comprising:

a processor;

a machine-readable medium comprising program code executable by the processor to cause the apparatus to, based on detection of attitude measurements and drilling operation parameters measurements from drilling of a wellbore trajectory that includes at least one curve section, generate a curvature error with respect to a curvature setpoint and an attitude error with respect to an attitude setpoint based, at least in part, on the attitude measurements;

select a predetermined control gain vector correlated to the drilling operation parameters measurements; and input the curvature error, the attitude error, and the predetermined control gain vector into a model-based controller, which is configured with a wellbore propagation model, to obtain steering inputs; and communicate the steering inputs to influence the drilling at least through the curve section of the wellbore trajectory.

19. The apparatus of claim 18, wherein the program code to select the predetermined control gain vector correlated to the drilling operation parameters measurements comprise instructions executable by the processor to cause the apparatus to query a lookup table with the drilling operation parameters measurements, wherein the lookup table correlates a plurality of control gain vectors to combinations of measurements of a plurality of drilling operation parameters measurements.

20. The apparatus of claim 18, wherein the program code to select the predetermined control gain vector correlated to the drilling operation parameters measurements comprise instructions executable by the processor to cause the apparatus to query a lookup table with the drilling operation parameters measurements, wherein the lookup table correlates a plurality of control gain vectors to combinations of ranges of measurements of a plurality of drilling operation parameters measurements.

* * * * *